US007749051B2

(12) United States Patent
Zaiser

(10) Patent No.: US 7,749,051 B2
(45) Date of Patent: Jul. 6, 2010

(54) METHOD AND APPARATUS FOR ALIGNING OPTICAL ELEMENTS

(75) Inventor: Michael Zaiser, Boebingen (DE)

(73) Assignee: Carl Zeiss SMT AG, Oberkochen (DE)

( * ) Notice: Subject to any disclaimer, the term of this patent is extended or adjusted under 35 U.S.C. 154(b) by 24 days.

(21) Appl. No.: 10/518,994

(22) PCT Filed: Jun. 26, 2003

(86) PCT No.: PCT/EP03/06722

§ 371 (c)(1),
(2), (4) Date: Dec. 21, 2004

(87) PCT Pub. No.: WO2004/002678

PCT Pub. Date: Jan. 8, 2004

(65) Prior Publication Data

US 2005/0168691 A1 Aug. 4, 2005

(30) Foreign Application Priority Data

Jun. 28, 2002 (DE) ..... 102 29 150

(51) Int. Cl.
*B24B 1/00* (2006.01)

(52) U.S. Cl. ..... 451/41; 451/42; 451/384

(58) Field of Classification Search ..... 451/45, 451/277, 390, 41, 42, 43, 44, 384
See application file for complete search history.

(56) References Cited

U.S. PATENT DOCUMENTS 2,441,472 A * 5/1948 D'Avaucourt ..... 451/384
2,879,632 A * 3/1959 Allen et al. ..... 451/390
2,982,061 A * 5/1961 Dillon ..... 451/460
3,226,887 A * 1/1966 Rudd et al. ..... 451/42
3,417,454 A * 12/1968 Beasley ..... 29/468
3,618,271 A * 11/1971 Martiros ..... 451/41
3,815,294 A * 6/1974 Martiros ..... 451/42
4,267,672 A * 5/1981 Sorrells ..... 451/42
4,341,045 A * 7/1982 Sorrells ..... 451/390
4,358,913 A * 11/1982 Sorrells ..... 451/390
4,535,575 A * 8/1985 Sorrells ..... 451/384
4,543,752 A * 10/1985 Kotting ..... 451/460
4,759,154 A * 7/1988 Morland et al. ..... 451/333

(Continued)

FOREIGN PATENT DOCUMENTS

EP 0 732 172 A1 9/1996

*Primary Examiner*—Maurina Rachuba
(74) *Attorney, Agent, or Firm*—Wells St. John P.S.

(57) ABSTRACT

In the case of a method and an apparatus for manually aligning ophthalmic spectacle lenses (5), in particular semifinished products of progressive lenses, the spectacle lens is held for the purpose of machining the free side of the spectacle lens by a first holder via a connecting material situated therebetween. The holder is inserted into a cutout of a retaining device, the free side being machined. After machining of the free side of the spectacle lens, the first holder is inserted into a cutout of an adapter part that is provided with markings. Thereafter, the spectacle lens is aligned with the aid of the markings of the adapter part, the spectacle lens being held in a second holder via a further connecting material situated therebetween. The second holder is subsequently inserted in the retaining device. Finally, the first holder is removed from the spectacle lens together with the adapter part and the connecting material.

25 Claims, 5 Drawing Sheets

U.S. PATENT DOCUMENTS 5,210,695 A * 5/1993 Wood ..... 700/164
5,269,102 A * 12/1993 Wood ..... 451/550
5,462,475 A * 10/1995 Kennedy ..... 451/384
5,520,568 A 5/1996 Craighead et al.
5,711,196 A * 1/1998 Reid et al. ..... 82/1.11
5,737,057 A * 4/1998 Kojima et al. ..... 351/177
5,785,580 A * 7/1998 Cook ..... 451/42
5,919,563 A * 7/1999 Parish et al. ..... 428/354
5,951,376 A * 9/1999 Mandler ..... 451/43
6,071,176 A 6/2000 Kruls
6,383,061 B1 5/2002 Mandler
6,419,570 B1 * 7/2002 Werner ..... 451/390
6,445,515 B2 9/2002 Moennig
6,466,380 B2 10/2002 Bischoff
6,538,829 B2 3/2003 Rau et al.
6,552,862 B2 4/2003 Dieker
6,580,570 B2 6/2003 Becker et al.
6,594,093 B2 7/2003 Moeller et al.
6,603,615 B2 8/2003 Melzer et al.
6,641,466 B2 * 11/2003 Wallendorf et al. ..... 451/285
6,667,255 B2 12/2003 Hexels
6,667,839 B2 12/2003 Hartmaier et al.
6,717,742 B2 4/2004 Weber
6,727,984 B2 4/2004 Becht
6,733,369 B1 5/2004 Stacklies et al.
6,768,600 B2 7/2004 Dieker
6,791,768 B2 9/2004 Rau
6,798,588 B2 9/2004 Vogt
6,816,325 B1 11/2004 Becker et al.
6,825,914 B2 11/2004 Schroeder et al.
6,829,107 B2 12/2004 Osterried
6,844,994 B2 1/2005 Melzer et al.
7,059,037 B2 * 6/2006 Bergandy et al. ..... 29/799
7,150,672 B2 * 12/2006 Mizuno ..... 451/5
7,189,147 B2 * 3/2007 Igarashi et al. ..... 451/42
7,369,238 B2 * 5/2008 Wagner et al. ..... 356/399
2005/0250430 A1 * 11/2005 Volken et al. ..... 451/390

* cited by examiner

METHOD AND APPARATUS FOR ALIGNING OPTICAL ELEMENTS

CROSS REFERENCE TO RELATED APPLICATION

This is a 35 U.S.C. §371 application of and claims priority to PCT International Application Number PCT/EP 03/006722, which was filed 26 Jun. 2003 (26.06.03), and was published in German which was based on German Patent Application No. 102 29 150.0 which was filed 28 Jun. 2002 (28.06.02) and the teachings of which are incorporated herein by reference.

BACKGROUND OF THE INVENTION

1. Field of the Invention

The invention relates to a method for manually aligning ophthalmic spectacle lenses, in particular semifinished products of progressive lenses, the spectacle lens being held on one side for the purpose of machining the free side of the spectacle lens by a holder via a connecting material situated therebetween, and the holder being inserted into a cut-out of a retaining device. The invention also relates to an apparatus for manually aligning ophthalmic spectacle lenses.

2. Description of the Related Art

The method known from practice and applied in order to align a spectacle lens for subsequent blocking onto a holder for further machining is performed by stamping on a marking and subsequently aligning the spectacle lens with the aid of this stamped marking. The position of the marking on the spectacle lens is prescribed by two marks introduced into the spectacle lens. Simple semifinished products that are machined only on one side of the spectacle lens already have this marking applied.

In the case of individual spectacle lenses, both sides of the semifinished product can be machined. For this reason, it is necessary after the machining of a first side for the semifinished product to be placed on a new holder for the purpose of machining the second side. In this process, on the second holder the spectacle lens must exhibit exactly the same positioning in the plane perpendicular to the optical axis as on the first holder. This requires the spectacle lens to be released from its holder after the first machining process and cleaned so that the marking can be stamped onto the spectacle lens for the alignment of the second holder.

This method has the disadvantage that a new placement of a marking and the later alignment with the aid of this marking are subject to certain tolerances. Likewise, cleaning before stamping the marking is a time—consuming and cost—intensive production process.

DE 696 06 340 T2 discloses a method for producing an ocular lens, the lens material being aligned with the block by rotating the lens material and the block relative to one another. The workspindle of the first machining device is rotated, the block being movable in directions orthogonal to a rotation axis of the workspindle of the first machining device. An ultraviolet curing adhesive agent is used in this case as adhesive agent, ultraviolet rays being radiated onto the lens material and the block after the lens material has been aligned with the block. The lens material is clamped by means of a loader while it is being guided by a chuck of a workspindle of a device for machining inner surfaces. The ultraviolet curing adhesive agent is dripped onto a surface of the block that is to be bonded. Thereafter, the bonding surface of the block is arranged in an alignment operation such that the bonding surface overlaps with the machined surface of the lens material. The block and the lens material are thus aligned relative to one another, while being caused to rotate relative to one another by slow rotation of the workspindle. UV irradiation is required to bond the block to the lens material. A surface of the lens material can be machined thereafter.

Utility model DE 297 23 542 U1 discloses an apparatus for machining optical lenses. Such an apparatus is related, in particular, to the grinding of lens blanks. The lens blank is inserted into a chucking tool of a workpiece spindle and clamped mechanically on its clamping shoulder by means of an automatically actuable chucking tool, the chucking tool being a vacuum-assisted collet chuck. A coarse grinding tool on the workpiece spindle can be used to grind the lens body coarsely. After machining of a first side, the same apparatus can likewise be used to machine the second side.

Although the utility model DE 297 23 542 U1 relates to mineral lenses, the abovenamed apparatus cannot be used for spectacle lenses. After the machining of one surface, the lens is rotated and clamped at the circular circumference in a workpiece spindle for the machining of the second surface. However, this is not possible for spectacle lenses since, particularly in the case of spectacle lenses for correcting hyperopie it is necessary for these to be produced with as thin a rim as possible, for which reason they cannot be machined at the rim or in the vicinity of the rim. Then, there would be a very high risk of damaging the spectacle lens by the operation of clamping the thin rim. It is therefore impossible to use the apparatus and/or the method advised above for spectacle lenses. It is likewise disadvantageous that spectacle lenses which are to exhibit a reduction in central thickness, as a result of which the rim must exhibit a free form profile, cannot be clamped in a collet chuck.

SUMMARY OF THE INVENTION

It is therefore the object of the present invention to eliminate the abovementioned disadvantages of the method for aligning a semifinished product, and to simplify and accelerate the process cycle for producing an ophthalmic spectacle lens, in particular a progressive lens.

This object is achieved according to the invention by virtue of the fact that after machining of a free side of the spectacle lens a) the first holder is inserted into a cutout of an adapter part that is provided with markings, b) the spectacle lens is subsequently aligned with the aid of the markings of the adapter part, and the spectacle lens is connected to a second holder, the second holder being positioned and fixed into a retaining device, and c) the first holder is finally removed with the adapter part from the spectacle lens together with the connecting material.

Since the semifinished product of the spectacle lens, in particular of the progressive lens, already exhibits a defined position on a holder, according to the invention it is now precisely this positioning that is to be maintained until a second holder has been brought up in accurate position to the semifinished product of the spectacle lens. Use is made for this purpose in the method according to the invention of an aligning device that has markings for alignment. Owing to the defined positioning of the first holder, on which the semifinished product of the spectacle lens is blocked, in the aligning device, it is possible to use markings on the aligning device to align the semifinished product and block it onto a second holder. Thereafter, the first holder is removed together with the connecting material. This eliminates the intermediate process of "cleaning" for marking and "stamping" it on.

The essential feature of the method and of the aligning device consists according to the invention in that the defined position of the semifinished product of the spectacle lens on the first holder is maintained until the semifinished product is placed in a defined fashion on the second holder is placed in a defined fashion on the second holder.

This mode of procedure is substantially more accurate and quicker than releasing the defined positioning and renewing the application of a marking in order thereafter to undertake a defined alignment again. It is thereby advantageously possible to align quickly and precisely even spectacle lenses that have a freeform profile at the rim.

When the aligning device is designed as positioning device in a development of the invention, and the first holder is inserted into a cutout of the positioning device, the intermediate process of "aligning" is eliminated since the aligning device with the semifinished product of the spectacle lens is guided via the positioning device into an exactly defined position, and fixed. The second holder can thus be applied directly.

The advantage of this mode of procedure consists in that the semifinished product of the spectacle lens assumes with the aid of the first holder an exactly defined position in the positioning device, as a result of which there is no longer a need for the aligning process which has a certain inherent tolerance and employs markings on the aligning device and/or markings on the semifinished product.

Further advantageous refinements of the invention emerge from the remaining subclaims and from the exemplary embodiments illustrated below with the aid of the drawings.

DETAILED DESCRIPTION

Figure 1:
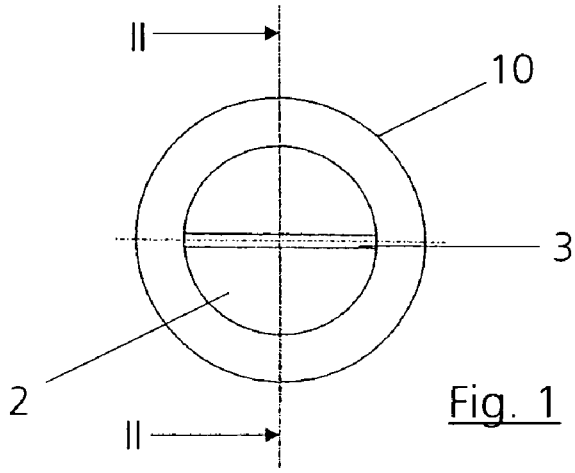
FIG. 1 shows an aligning device with an aligning reference (illustrated here as transverse web)
Figure 2:
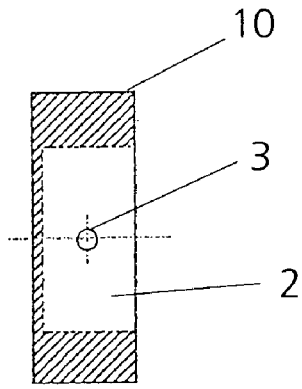
FIG. 2 shows an aligning device according to FIG. 1 in section along the line II-II.
Figure 3:
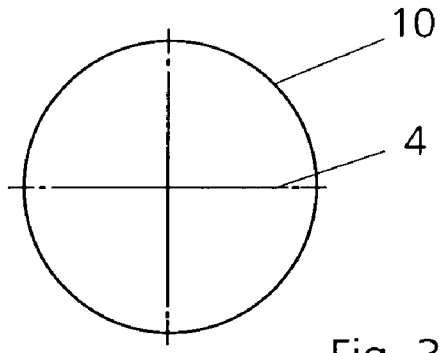
FIG. 3 shows an aligning device according to FIG. 1 with its markings (illustrated here as cross hairs)

FIGS. 1 to 3 show an adapter part 10 for an aligning device 1 such as is indicated in FIGS. 4 to 7. In the lower region, the adapter part 10 has a cylindrical cavity 2. Incorporated in the cavity 2 is a transverse web 3 that constitutes a reference for a first holder 6 (see FIG. 6). Markings 4, illustrated here in the form of cross hairs, are located, as shown in FIG. 3, on the opposite side of the transverse web 3, as shown in FIG. 3, on the opposite side of the transverse web 3. These markings 4 serve for aligning a semifinished product of an ophthalmic spectacle lens before being placed on a second holder 9 (see FIG. 5), the spectacle lens advantageously being designed as an organic progressive lens. Of course, it is also possible to align mineral spectacle lenses (specifically progressive lenses) with the aid of the adapter part 10.

Figure 4:
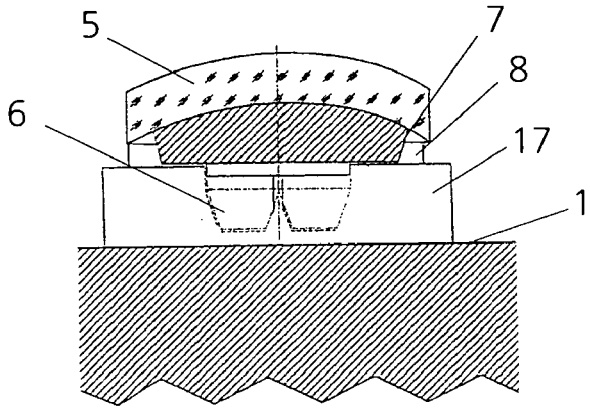
FIG. 4 shows an aligning device with a semifinished product of the spectacle lens, the semifinished product being located on a first blocked holder.

FIG. 4 shows a spectacle lens 5, specifically a prefabricated product for a spectacle lens, with its holder 6, the prefabricated product being laid with the first holder 6 on a blocking ring 8. The blocking ring 8 lies on a retaining device 17 of the aligning device 1. The prefabricated product is already connected to the first holder 6 by the introduction of connecting material 7. The first side can subsequently be machined or mechanically ground. Before the introduction of the connecting material 7, when organic spectacle lenses are used, the side of the spectacle lens 5 should be provided with a protective layer that connects to the connecting material 7. The protective layer can be ensured by bonding on a plastic film or by spraying on a coating. This provides protection against possible damage to the spectacle lens surface. At the same time, the protective layer increases the adhesion between the connecting material 7 and spectacle lens 5, since during the later surface machining corresponding forces act on the connecting point of such type between the spectacle lens 5 and connecting material 7.

Figure 5:
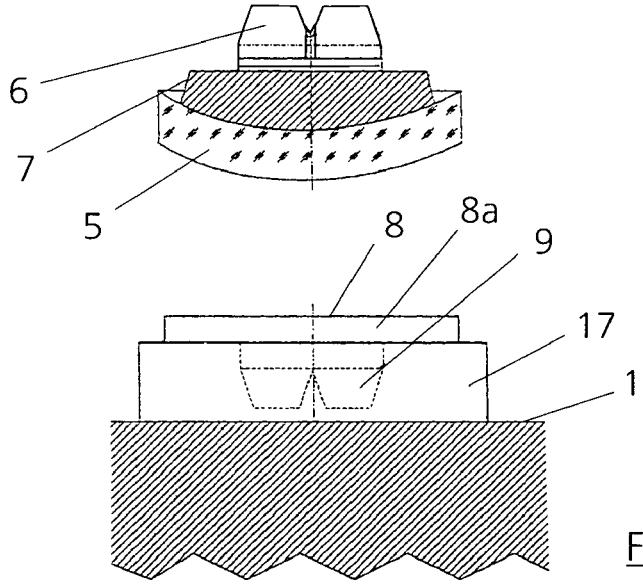
FIG. 5 shows an aligning device for exactly aligning and placing the semifinished product of the spectacle lens on a second holder, the first holder being retained.

FIG. 5 shows the semifinished product of the spectacle lens 5 with the first holder 6 after the machining of the first side. The semifinished product 5 is laid on the blocking ring 8 with the side already machined. A second holder 9 is already located in the retaining device 17 of the aligning device 1.

Figure 6:
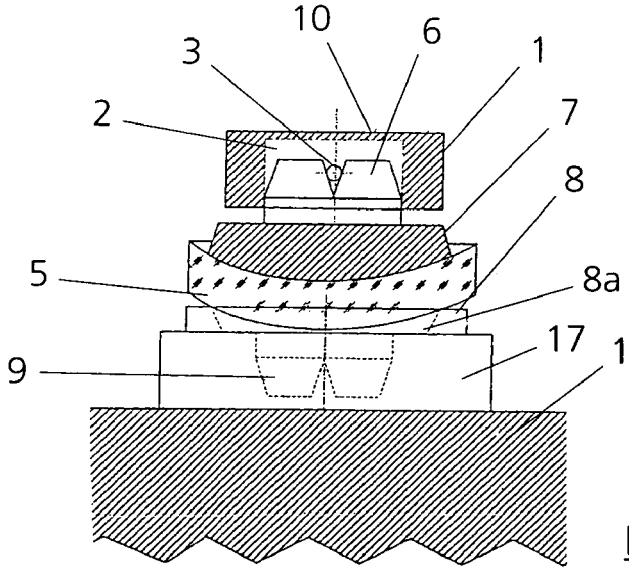
FIG. 6 shows an aligning device with adapter plate for aligning the semifinished product of the spectacle lens, for placing the second holder.

FIG. 6 shows the semifinished product of the spectacle lens 5 with its first blocked holder 6 on the aligning device 1. The first holder 6 is inserted in the cavity 2, the adapter part 10 illustrated in FIGS. 1 to 3, the transverse web 3 permitting precise positioning. The adapter part 10 serves for manually aligning the semifinished product 5 with the aid of markings 4, the semifinished product 5 with the adapter part 10 being aligned relative to the blocking ring 8. The semifinished product 5 lies with its first machined side on the blocking ring 8. After exact alignment, the semifinished product 5 is connected to the second holder 9 by the injection of connecting material into the cavity 8*a* of the blocking ring 8. Only now is the first holder 6 released from the semifinished product 5 together with the connecting material, as a result of which the side of the semifinished product of the spectacle lens 5 exposed in this way can be machined after the removal of the protective layer. Here, as well, it is expedient to introduce a protective layer between the spectacle lens 5 and holder 9 in order to protect the first machined side of the semifinished product of the spectacle lens 5.

Figure 7:
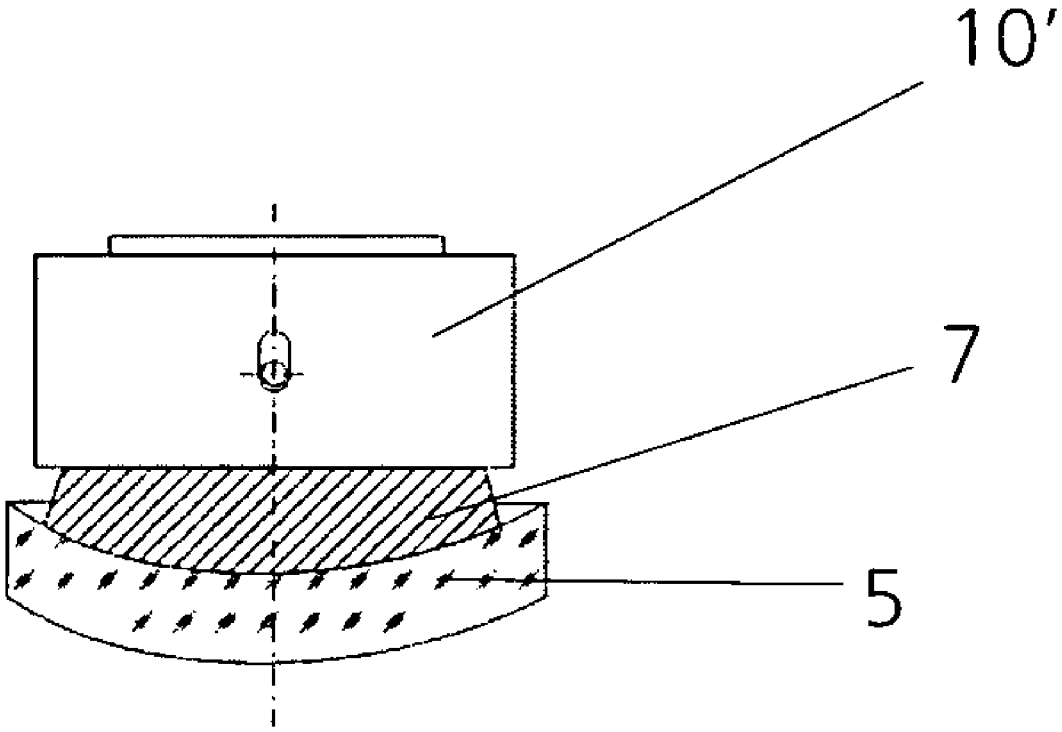
FIG. 7 shows an alternative design of the adapter plate for aligning the semifinished product of the spectacle lens.

FIG. 7 shows a further possibility of configuring the adapter part 10 for aligning the semifinished product of the spectacle lens 5. The already existing adapter part 10 can be improved in this case to the effect that instead of the adapter part 10 a collet chuck 10' that is supported (not illustrated) in the housing is provided for positioning the holder 9. In order to release the collet chuck 10', it is possible to press onto the collet chuck 10' from above, for example by means of a pneumatic cylinder, in order to remove or insert the spectacle lens or the semifinished product 5.

The essential advantage of the collet chuck 10' consists in the exact, backlash-free positioning of the holder 6 and thus of the semifinished product 5 in the adapter part 10. It is thereby possible further to reduce the inaccuracies when reblocking the semifinished product 5. Only the positioning of the adapter plate 10 with the collet chuck 10' on the holder 6 remains as a possible influence on the accuracy when reblocking is carried out manually.

Figure 8:
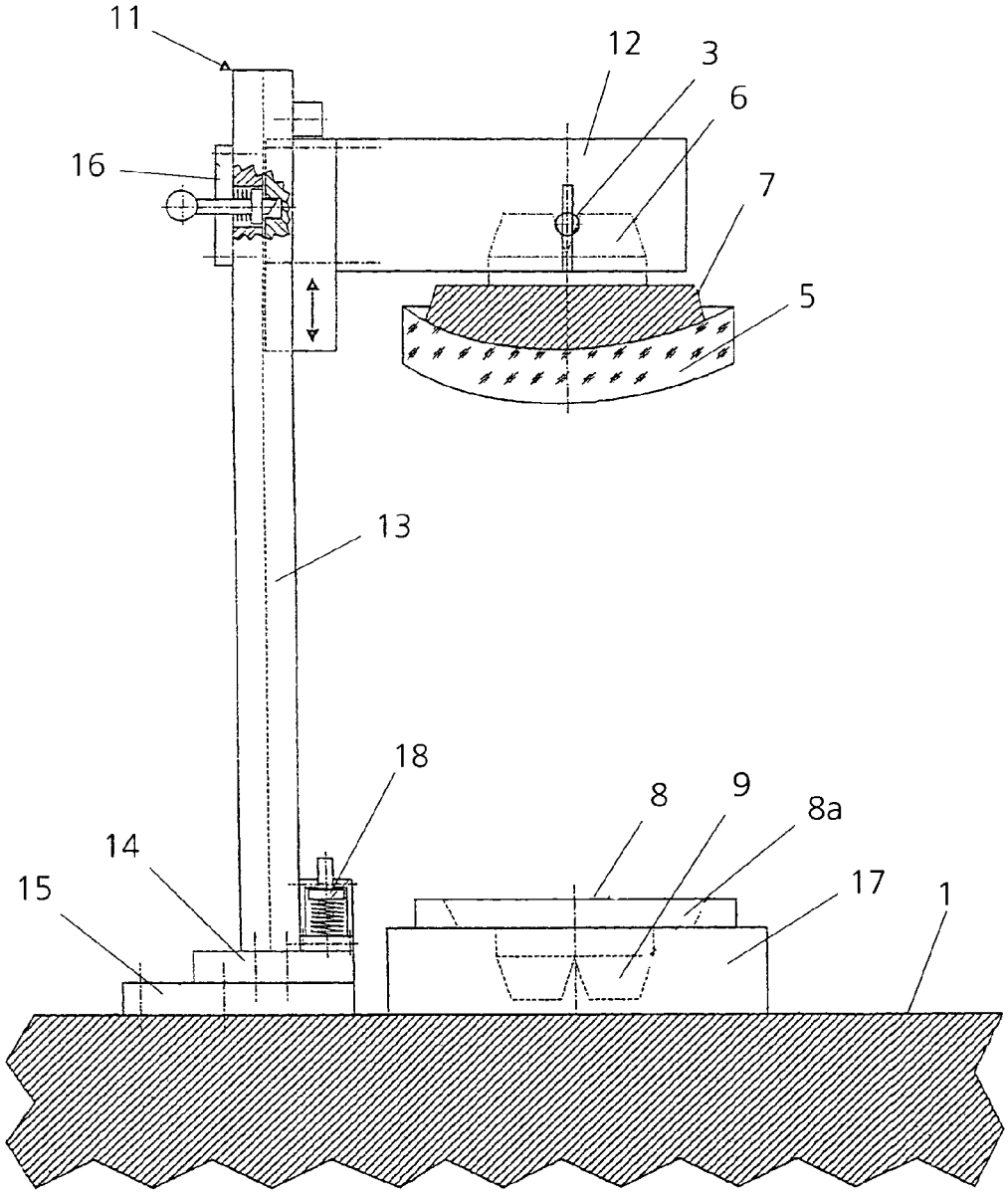
FIG. 8 shows a positioning device with holding means for the semifinished product of the spectacle lens and an integrated aligning device.

FIG. 8 shows a positioning device 11 for the aligning device 1. As on the adapter part 10 in accordance with FIGS. 1 to 3, markings 4 are superfluous here. The first holder 6 is integrated here in a clamping device 12. The clamping device 12 contains the transverse web 3 for inserting and aligning the first holder 6, and a clamping mechanism for fixing the first holder 6 in the clamping device 12. The clamping device 12 is mounted on a guide 13. The clamping device 12 can be mounted thereon in two positions. Firstly, in the positioning attitude, and secondly in the holding attitude. The guide 13 is fixedly connected to an xy table 14. The latter is required for aligning the guide 13 and the clamping device 12 in relation to the blocking ring 8. The xy table 14 can be displaced in a plane in a fashion parallel to the blocking ring 8. Furthermore, the xy table is connected to the conventional aligning device 1 by an adapter plate 15. In order now to block an ophthalmic spectacle lens 5 onto the second holder 9, the clamping device 12, in which the first holder 6 is already located, is moved along the guide in the z-direction and centered on the blocking ring 8. There, the ophthalmic spectacle lens 5 is blocked onto the second holder 9. The positioning device 11 can be operated mechanically, electrically and pneumatically. In the case of mechanical operation, it can also have an end position lock 16 in the holding attitude. An end position damper 18 is also possible for the positioning attitude in order to prevent damage to the semifinished product of the spectacle lens 5 during blocking onto the second holder 9. By contrast with manual alignment, the alignment can also be performed automatically matically with the aid with the aid of a handling device (not illustrated), for example with the aid of a robot.

Figure 9:
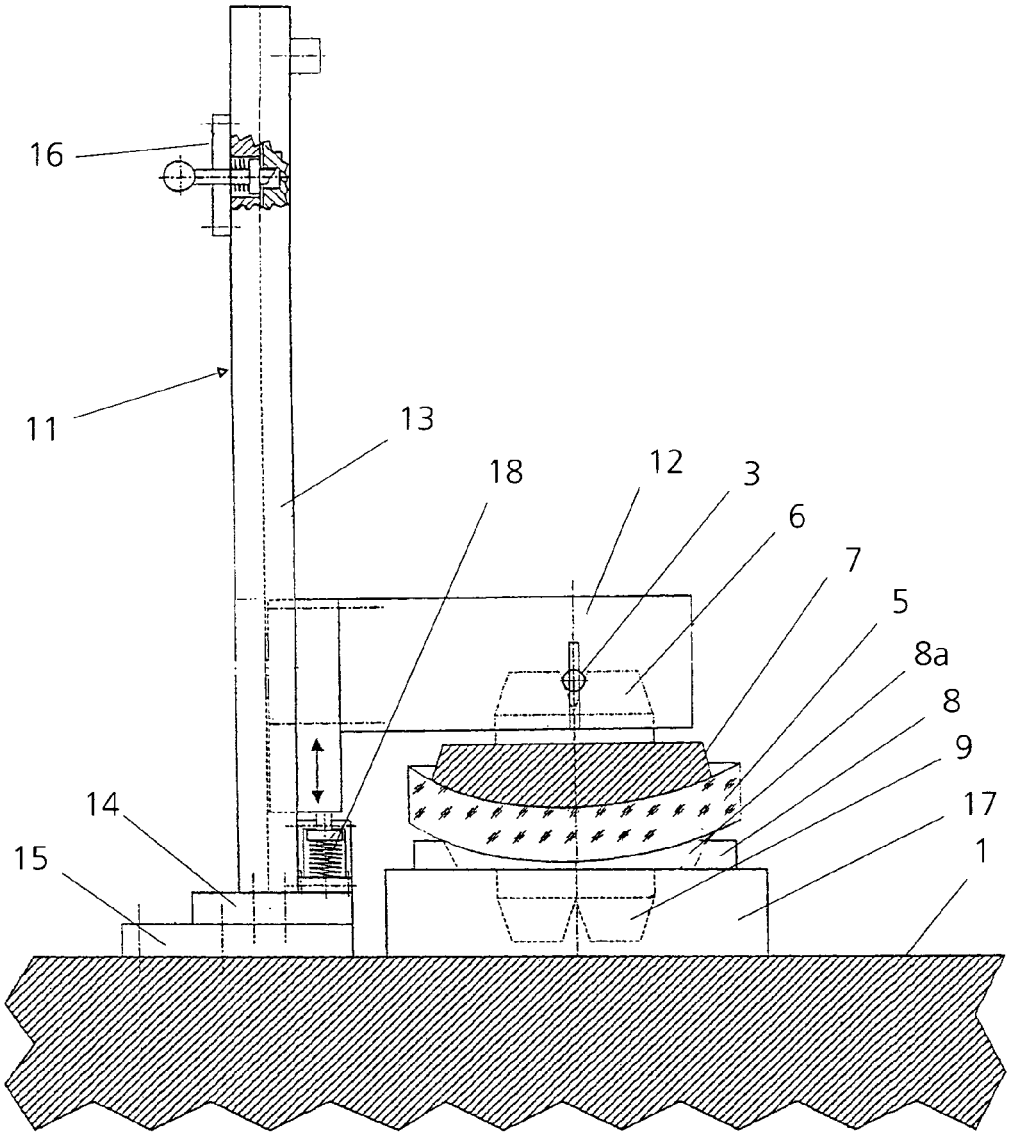
FIG. 9 shows a positioning device according to FIG. 8 with an aligning device for blocking the second holder onto the semifinished product of the spectacle lens.

FIG. 9 shows the positioning device 11 according to FIG. 8 in its positioning attitude for positioning the semifinished product of the spectacle lens 5 on the second holder 9, a protective layer being applied to the spectacle lens 5. The connecting material is subsequently sprayed into the interspace 8*a* of the blocking ring 8. The semifinished product 5 can then be removed from the clamping device 12 and thus from the positioning device 11, and the first holder 6 can be removed together with the connecting material 7 so that the second side of the semifinished product 5 can be machined.

What is claimed is:

1. A method for aligning a spectacle lens comprising:

providing a spectacle lens comprising a machined first side and a second side, the second side of the spectacle lens is secured to a first holder by a first connecting material;

positioning the first holder relative an adapter part, the adapter part comprising an alignment reference and a marking, wherein the positioning comprises aligning the first holder relative the alignment reference;

aligning said spectacle lens relative a second holder using the marking of the adapter part; and after the aligning of the spectacle lens relative the second holder, providing a second connecting material to the second holder.

2. The method as claimed in claim 1 further comprising:

connecting said spectacle lens to said second holder with the second connecting material;

inserting said second holder in a retaining device; and removing said first holder, said first connecting material and said adapter part from said spectacle lens.

3. The method as claimed in claim 1 wherein the positioning of said first holder comprises using a collet chuck in physical contact with the first holder.

4. The method as claimed in claim 1 wherein said spectacle lens comprises an organic spectacle lens, and wherein said organic spectacle lens comprises an organic progressive lens.

5. An adapter part for aligning spectacle lenses, the spectacle lenses having a machined first side and a second side, said second side is provided with a first holder, the adapter part comprising:

an alignment reference and a collet chuck, the collet chuck in physical contact with the first holder, the alignment reference and the collet chuck position said first holder relative said adapter part;

markings align said spectacle lenses relative other structures;

wherein said alignment reference comprises a transverse web extending generally perpendicularly to an optical axis of the spectacle lenses; and wherein an entirety of the outer peripheral configuration of the adapter part comprises a cylindrical configuration having one side with an opening extending partially into the cylindrical configuration, the opening configured as a cylindrical opening, and wherein the structure of the alignment reference is positioned along the diameter within the cylindrical opening.

6. The adapter part as claimed in claim 5 wherein said markings are provided on another side of the adapter part opposite the one side with said cylindrical opening.

7. An adapter part for aligning spectacle lenses, the adapter part comprising:

an alignment reference structure comprising physical material and extending from a surface of the adapter part, the alignment reference structure positions a first holder relative the adapter part;

markings align said spectacle lenses relative other structures;

wherein said alignment reference structure comprises a transverse web extending generally perpendicularly to an optical axis of the spectacle lenses; and wherein an entirety of the outer peripheral configuration of the adapter part comprises a cylindrical configuration having one side with an opening extending partially into the cylindrical configuration, the opening configured as a cylindrical opening, and wherein the alignment reference structure is positioned along the diameter within the cylindrical opening.

8. The method as claimed in claim 1 wherein the positioning of said first holder comprises providing a collet chuck in physical contact with the first connecting material.

9. The method as claimed in claim 1 further comprising releasing the spectacle lens from the adapter part by applying pressure to the adapter part along an axis parallel to an optical axis of the spectacle lens.

10. The adapter part as claimed in claim 5 wherein the collet chuck is in physical contact with connecting material.

11. The adapter part as claimed in claim 5 wherein the alignment reference is in physical contact with the first holder.

12. The adapter part as claimed in claim 7 wherein the markings comprise cross hairs.

13. The adapter part as claimed in claim 7 wherein the alignment reference structure extends in a single direction.

14. The adapter part as claimed in claim 7 wherein the alignment reference structure extends across the cylindrical opening in the adapter part.

15. A method of using an adapter part for aligning spectacle lenses, the method comprising:

providing a spectacle lens comprising a machined first side and a second side;

securing the second side of the spectacle lens to a holder;

providing an adapter part comprising a collet chuck, the collet chuck comprising an alignment reference extending generally perpendicularly to an optical axis of the spectacle lenses;

aligning the collet chuck relative the holder by physically contacting the holder and the alignment reference; and releasing the spectacle lens from the collet chuck by applying pressure to the collet chuck along an axis parallel to an optical axis of the spectacle lens.

16. The method of claim 1 wherein the spectacle lens during machining of the first side is oriented in a position in a plane perpendicular to an optical axis of the spectacle lens, and wherein the aligning using the marking of the adapter part comprises providing the spectacle lens in the same position in the plane perpendicular to the optical axis of the spectacle lens.

17. The method of claim 1 wherein the second side of the spectacle lens is concave, and wherein the connecting material contacts substantially an entirety of the second side.

18. The method of claim 1 further comprising providing a protective layer over the second side of the spectacle lens.

19. The method of claim 1 further comprising providing a plastic film over the second side of the spectacle lenses.

20. The adapter part of claim 5 wherein the markings comprise only two lines intersecting.

21. The adapter part of claim 7 wherein the markings comprise two lines intersecting at right angles.

22. The method of claim 15 further comprising spraying a coating over the second side of the spectacle lens.

23. The method of claim 1 wherein the providing of the second connecting material to the second holder further comprises providing the second connecting material simultaneously to the spectacle lens.

24. The method of claim 1 wherein the providing of the second connecting material comprises injecting the second connecting material onto the second holder.

25. The method of claim 1 further comprising removing the first holder together with the first connecting material from the spectacle lens.

* * * * *

UNITED STATES PATENT AND TRADEMARK OFFICE

CERTIFICATE OF CORRECTION

PATENT NO. : 7,749,051 B2
APPLICATION NO. : 10/518994
DATED : July 6, 2010
INVENTOR(S) : Michael Zaiser It is certified that error appears in the above-identified patent and that said Letters Patent is hereby corrected as shown below:

Title page, (73) Assignee: replace "Carl Zeiss SMT AG: Oberkochen (DE)
with --Carl Zeiss Vision GMBH: Aalen (DE)--.

Column 5, (31): replace "automatically matically with the aid with the aid"
with --automatically with the aid--.

Signed and Sealed this
Nineteenth Day of June, 2012

David J. Kappos

David J. Kappos
*Director of the United States Patent and Trademark Office*